US008157962B2

(12) United States Patent
Simonson et al.

(10) Patent No.: US 8,157,962 B2
(45) Date of Patent: Apr. 17, 2012

(54) PROCESS FOR THE PRODUCTION OF CELLULOSIC PRODUCT

(75) Inventors: Patrik Simonson, Sävedalen (SE); Marek Tokarz, Göteborg (SE); Katarina Gutke, Fjärås (SE)

(73) Assignee: Akzo Nobel N.V., Arnhem (NL)

( * ) Notice: Subject to any disclaimer, the term of this patent is extended or adjusted under 35 U.S.C. 154(b) by 162 days.

(21) Appl. No.: 12/520,638

(22) PCT Filed: Dec. 18, 2007

(86) PCT No.: PCT/SE2007/051032

§ 371 (c)(1),
(2), (4) Date: Jul. 28, 2009

(87) PCT Pub. No.: WO2008/076071

PCT Pub. Date: Jun. 26, 2008

(65) Prior Publication Data

US 2010/0032117 A1 Feb. 11, 2010

Related U.S. Application Data

(60) Provisional application No. 60/876,369, filed on Dec. 21, 2006.

(30) Foreign Application Priority Data

Dec. 21, 2006 (EP) ..... 06126786

(51) Int. Cl.
*D21H 11/00* (2006.01)

(52) U.S. Cl. ..... 162/181.2

(58) Field of Classification Search ..... 162/181.2, 162/164.5

See application file for complete search history.

(56) References Cited

U.S. PATENT DOCUMENTS

| | | | | |
|---|---|---|---|---|
| 4,388,150 | A | 6/1983 | Sunden et al. | |
| 4,753,710 | A | 6/1988 | Langley et al. | |
| 4,927,498 | A | 5/1990 | Rushmere | |
| 4,954,220 | A | 9/1990 | Rushmere | |
| 4,961,825 | A | 10/1990 | Andersson et al. | |
| 4,980,025 | A | 12/1990 | Andersson et al. | |
| 5,071,512 | A | 12/1991 | Bixler et al. | |
| 5,127,994 | A | 7/1992 | Johansson | |
| 5,176,891 | A | 1/1993 | Rushmere | |
| 5,368,833 | A | 11/1994 | Johansson et al. | |
| 5,447,604 | A | 9/1995 | Johansson et al. | |
| 5,470,435 | A | 11/1995 | Rushmere et al. | |
| 5,543,014 | A | 8/1996 | Rushmere et al. | |
| 5,571,494 | A | 11/1996 | Saastamoinen | |
| 5,573,674 | A | 11/1996 | Lind et al. | |
| 5,584,966 | A | 12/1996 | Moffett | |
| 5,603,805 | A | 2/1997 | Andersson et al. | |
| 5,607,552 | A | 3/1997 | Andersson et al. | |
| 5,688,482 | A | 11/1997 | Saastamoinen | |
| 5,707,493 | A | 1/1998 | Saastamoinen | |
| 5,755,930 | A | 5/1998 | Satterfield et al. | |
| 5,858,174 | A | 1/1999 | Persson et al. | |
| 6,379,501 | B1 | 4/2002 | Zhang et al. | |
| 6,918,995 | B2 * | 7/2005 | Frolich et al. | 162/164.5 |
| 2003/0079848 | A1 | 5/2003 | Ahlgren et al. | |

FOREIGN PATENT DOCUMENTS

| | | | |
|---|---|---|---|
| EP | 0 348 366 | A2 | 12/1989 |
| EP | 0 700 473 | B2 | 3/1996 |
| WO | WO 93/14263 | A1 | 7/1993 |
| WO | WO 01/40577 | A1 | 6/2001 |
| WO | WO 01/44573 | A1 | 6/2001 |
| WO | WO 2004/005192 | A1 | 1/2004 |

OTHER PUBLICATIONS

International Search Report for International Application No. PCT/SE2007/051032 dated Apr. 4, 2008.

Sears Jr. G.W., "Determination of Specific Surface Area of Colloidal Silica by Titration with Sodium Hydroxide," Dec. 1956, pp. 1981-1983, vol. 28, No. 12.

Iler et al., "Degree of Hydration of Particles of Colloidal Silica in Aqueous Solution," Jul. 1956, pp. 955-957.

* cited by examiner

*Primary Examiner* — Mark Halpern
(74) *Attorney, Agent, or Firm* — Robert C. Morriss

(57) ABSTRACT

The present invention relates to a process for the production of a cellulosic product which comprises providing an aqueous thick suspension containing cellulosic fibers having a fiber concentration of at least about 2% by weight; adding to the thick suspension an aluminum compound, alkaline earth metal salt and acid; diluting the obtained thick suspension to form a thin suspension; adding to the thin suspension one or more drainage and retention aids; and dewatering the obtained thin suspension. The invention further relates to a process for the production of a cellulosic product which comprises providing an aqueous thick suspension containing cellulosic fibers having a fiber concentration of at least about 2% by weight and an alkaline earth metal ion concentration of at least about 100 mg/l; adding to the thick suspension an aluminum compound and optionally an acid to obtain a pH of from about 4 to about 5.5; diluting the obtained thick suspension to form a thin suspension; adding to the thin suspension one or more drainage and retention aids; and dewatering the obtained thin suspension. The invention also relates to an aqueous composition comprising a mixture of an aluminum compound, alkaline earth metal salt and acid and the use of the composition.

20 Claims, No Drawings

PROCESS FOR THE PRODUCTION OF CELLULOSIC PRODUCT

This application is a national stage filing under 35 U.S.C. §371 of PCT/SE2007/051032, filed Dec. 18, 2007, which claims priority to European Patent Application No. 06126786.0, filed Dec. 21, 2006, and U.S. Provisional Patent Application No. 60/876,369, filed on Dec. 21, 2006, the contents of which are incorporated herein by reference in their entirety.

FIELD OF THE INVENTION

The present invention relates to a process for the production of a cellulosic product. More specifically, the invention relates to a process for the production of a cellulosic product which comprises adding certain additives to an aqueous suspension containing cellulosic fibers before it is dewatered to form the cellulosic product.

BACKGROUND OF THE INVENTION

In the papermaking art, an aqueous suspension containing cellulosic fibers, and optional fillers and additives, is fed into a headbox which ejects the suspension onto a forming wire. Water is drained from the suspension through the forming wire so that a wet web of paper is formed on the wire, and the paper web is further dewatered and dried in the drying section of the paper machine. Drainage and retention aids are conventionally introduced into the suspension in order to facilitate drainage and increase adsorption of fine particles onto the cellulosic fibers so that they are retained with the fibers on the wire.

Aqueous suspensions containing cellulosic fibers may contain, apart from cellulosic fibers, also compounds which have negative impact on the production process. Such compounds can be found both in suspensions originating from virgin pulp and from recycled pulp. Compounds which are released during the pulping and bleaching operations are commonly referred to as pitch. Examples of pitch include wood resins such as lipophilic extractives (fatty and resin acids, sterols, stearyl esters, triglycerides) and also fats, terpenes, terpeniods, waxes etc. These compounds contribute to a high anionic charge of the suspensions.

Further, especially in closed mills where white water is extensively re-circulated, the suspensions may also comprise charged contaminants like salts and various wood polymers of which the charged, low charged and non-charged compounds compete with the cellulose with respect to the adsorption of and interaction with added performance chemicals such as drainage and retention aids, sizing agents, etc. Usually such disturbing compounds are referred to as anionic trash.

All the above-mentioned compounds interfere with the pulp and paper making processes in various ways. To compensate for the high anionic charge caused by disturbing substances, increased amounts of cationic additives, which contribute to improved dewatering and retention, have been used in the papermaking processes.

U.S. Pat. No. 4,388,150 discloses the use of a cationic starch together with colloidal silicic acid to improve retention and drainage and improve characteristics of resulting paper in a papermaking process in which mineral fillers are used.

EP-A 0 700 473 discloses a papermaking process in which retention and/or dewatering are improved by adding a cationic long-chain polyacrylamide to an aqueous suspension containing cellulosic fibers and then a polymeric aluminum salt and a base or an acid.

Despite the fact that considerable improvements have been achieved in the drainage and retention of the aqueous suspensions containing cellulosic fibers, there is still a need for improvements, especially when producing cellulosic products from aqueous cellulosic suspensions derived from mechanical pulps. Therefore, it is an object of this invention to provide a process for the production of a cellulosic product with further improvements in drainage and retention of the production process. Further objects will appear hereinafter.

SUMMARY OF THE INVENTION

The present invention is directed to a process for the production of a cellulosic product which comprises:

(i) providing an aqueous thick suspension containing cellulosic fibers having a fiber concentration of at least about 2% by weight;

(ii) adding to the thick suspension;

(I) an aluminum compound;

(II) an alkaline earth metal salt;

(III) an acid;

(iii) diluting the obtained thick suspension to form a thin suspension;

(iv) adding to the thin suspension one or more drainage and retention aids; and (v) dewatering the obtained thin suspension.

The present invention is also directed to a process for the production of a cellulosic product which comprises:

(i) providing an aqueous thick suspension containing cellulosic fibers having:

(a) a fiber concentration of at least about 2% by weight;

(b) an alkaline earth metal ion concentration of at least about 100 mg/l;

(ii) adding to the thick suspension an aluminum compound and optionally an acid to obtain a pH of from about 4 to about 5.5;

(iii) diluting the obtained thick suspension to form a thin suspension;

(iv) adding to the thin suspension one or more drainage and retention aids; and (v) dewatering the obtained thin suspension.

The present invention is further directed to an aqueous composition comprising a mixture of:

(I) an aluminum compound;

(II) an alkaline earth metal salt; and (III) an acid;

wherein the weight ratio of the aluminum compound, alkaline earth metal salt and acid ranges from about 60:1:0.1 to about 5:1:1.

The present invention is further directed to the use of the aqueous composition as an additive in a process for producing a cellulosic product.

DETAILED DESCRIPTION OF THE INVENTION

According to the present invention it has been found that drainage and retention can be improved without any significant impairment of formation, or even with improvements in paper formation, by a process which comprises adding an aluminum compound, alkaline earth metal salt and acid to an aqueous suspension containing cellulosic fibers having a fiber concentration of at least about 2% by weight, herein also referred to as a thick suspension, diluting the thick suspension to form a thin suspension, herein also referred to as a diluted suspension, and adding to the thin suspension one or more drainage and retention aids and dewatering the obtained thin suspension to form the cellulosic product.

The present invention provides improvements in drainage, retention and yield in the production of cellulosic products from all types of cellulosic suspensions, in particular suspensions containing mechanical or recycled pulp, and suspensions having high contents of salts (high conductivity) and colloidal substances, and in papermaking processes with a high degree of white water closure, i.e. extensive white water recycling and limited fresh water supply. Hereby the present invention makes it possible to increase the speed of the paper machine and to use lower dosages of additives to give corresponding drainage and/or retention effects, thereby leading to an improved papermaking process and economic benefits.

Aluminum compounds that can be used according to the invention include alum, aluminate, e.g. sodium or potassium aluminate, aluminum chloride, aluminum nitrate, and polyaluminum compounds, such as polyaluminum chloride, polyaluminum sulfate, and polyaluminum compounds containing both chloride and sulfate ions, polyaluminum silicate-sulfate, and mixtures thereof. The polyaluminum compounds may also contain other anions, for example anions from phosphoric acid, organic acids such as citric acid and oxalic acid. Alum, as used herein, includes not only a double salt of aluminum and potassium sulfate $K_2SO_4xAl_2(SO_4)_3x24H_2O$, but also aluminum sulfate $Al_2(SO_4)_3x14H_2O$, $Al_2(SO_4)_3x18H_2O$ and mixtures thereof. Examples of suitable aluminum compounds include those disclosed in U.S. Pat. No. 5,127,994, which is hereby incorporated herein by reference. Suitably, the aluminum compound is selected from alum, aluminum chloride, polyaluminum compounds such as polyaluminum chloride and polyaluminum silicate sulfate, and aluminate, preferably alum.

Alkaline earth metal salts that can be used according to the invention include magnesium, calcium and barium salts. The salts can have an anion selected from halides, sulfates, carbonates, nitrates or organic acids. Suitably, the alkaline earth metal salt is selected from magnesium and calcium salts, e.g. magnesium chloride, magnesium sulfate, calcium chloride and barium sulfate. Preferably, the alkaline earth metal salt is a magnesium salt. In a preferred embodiment of the invention, the alkaline earth metal salt is added to the thick suspension to obtain an alkaline earth metal ion concentration of at least about 100 mg/l, suitably at least about 150 mg/l and preferably at least 200 mg/l. The thick suspension can have a high concentration of alkaline earth metal salts based on $Ca^{2+}$ and $Mg^{2+}$ ions which salts can be derived from the cellulosic fibers and fillers used to form the suspension, in particular in integrated mills where a concentrated aqueous fiber suspension from the pulp mill normally is mixed with water to form a diluted suspension suitable for paper manufacture in the paper mill. The salts may also be derived from various additives introduced into the thick suspension and from the fresh water supplied to the process. The concentration of salts is usually higher in processes where white water is extensively recirculated, which may lead to considerable accumulation of salts in the water circulating in the process. Therefore, a thick suspension having an alkaline earth metal ion concentration of at least about 100 mg/l can be provided without any further addition of an alkaline earth metal salt.

Acids that can be used according to the invention include inorganic acids, for example sulfuric acid, hydrochloric acid, phosphoric acid, hydrochloric acid and nitric acid and organic acids, such as carboxylic acids, for example oxalic acid and citric acid. Preferably, the acid is an inorganic acid, preferably hydrochloric acid or sulfuric acid. The acid is added to the thick suspension to obtain a pH within the range of from about 2 to about 6, for example within the range of from about 4 to about 5.5. The defined pH range may also be obtained by only adding the aluminum compound to the thick suspension. In a further preferred embodiment of the invention, an acid is optionally added to the thick suspension to obtain a pH of from about 4 to about 5.5. Preferably, the addition of aluminum compound and optional acid according to the invention results in a pH reduction of the thick suspension to the indicated range. For instance, the think suspension to which the aluminum compound and optional acid are added can have a pH of at least about 6, e.g. at least about 6.5.

According to a preferred embodiment of the invention, one or more of the aluminum compounds, alkaline earth metal salts and acids are added to a think suspension of a pulp making process. The think suspension can be derived from several kinds of pulps, such as chemical pulp, such as sulfate and sulphite pulp, mechanical pulp, such as thermo-mechanical pulp, chemo-thermomechanical pulp, orgasolv pulp, refiner pulp or groundwood pulp from both softwood and hardwood, or fibers derived from one year plants like elephant grass, bagasse, flax, straw, etc., and suspensions based on recycled fibers. In a preferred embodiment of the invention, the think suspension contains cellulosic fibers derived from mechanical pulp, and preferably the content of mechanical pulp is at least 50% by weight, based on the total weight of the pulp. One or more of the aluminum compound, alkaline earth metal salt and/or acid can be added subsequent to chemical digestion, such as after the brown stock washer, or after refining of (chemo-) mechanical pulp. Usually, the pulp is bleached in a multi stage bleaching process comprising different bleaching stages. Examples of suitable bleaching stages include chlorine bleaching stages, e.g. elementary chlorine and chlorine dioxide bleaching stages, non-chlorine bleaching stages, e.g. peroxide stages like ozone, hydrogen peroxide and peracetic acid, and combinations of chlorine and non-chlorine bleaching and oxidizing stages, optionally in combination with reducing stages like treatment with dithionite. The pulp can be hydrogen peroxide bleached and one or more of the aluminum compound, alkaline earth metal salt and acid are added after the bleaching stages. In one preferred embodiment of the invention, one or more of the aluminum compound, alkaline earth metal salt and acid are added to the think suspension at the point of dilution after the bleaching stage. In another preferred embodiment of the invention, one or more of the aluminum compound, alkaline earth metal salt and acid are added to the thick suspension present in a mixer before the thick suspension reaches the pulp storage tank. In a further preferred embodiment of the invention, one or more of the aluminum compound, alkaline earth metal salt and acid are added to the think suspension after the storage tank on the way to paper mill mixing chest. At the point of addition of the aluminum compound, alkaline earth metal salt and acid, the think suspension has a fiber concentration of at least about 2%, suitably at least about 3% and preferably at least about 3.5% by weight. The concentration can be up to about 10% by weight. Preferably, when adding the aluminum compound, alkaline earth metal salt and acid to the thick suspension of a pulp making process, the thick suspension obtained is subsequently used in a paper making process in an integrated mill.

The aluminum compound, alkaline earth metal salt and acid, herein also referred to as the components, can be separately or simultaneously added to the thick suspension. When separately adding the components, they can be added in any order. Suitably, the aluminum compound is added prior to adding the alkaline earth metal salt and/or acid, and the alkaline earth metal salt can be added prior to, simultaneously with or after the acid. When simultaneously adding the components, they can be added separately and/or in the form of a mixture. Examples of suitable modes of simultaneous addition include adding the three components separately, in a composition comprising the components, and by adding one of the components separately and two of the components in the form of a mixture. The mixture may comprise the aluminum compound and one or both of the alkaline earth metal salt and acid. In a preferred embodiment of the invention, the aluminum compound and alkaline earth metal salt are simultaneously added as a mixture and acid is optionally added to the thick suspension.

The present invention further relates to an aqueous composition comprising a mixture of the above-mentioned components as well as the use thereof. The aqueous composition is suitably used as an additive in a process for the production of a cellulosic product, preferably as a drainage and retention aid in such a process. Preferably, the composition is used in combination with one or more drainage and/or retention aids, which preferably comprise at least one cationic polymeric retention agent and which are preferably added to the thin suspension. Preferably, the composition is aqueous. The aluminum compound, alkaline earth metal salt and acid can be present in a dry matter content varying within a wide range of from 5 to 99% by weight, suitably from 20 to 90% by weight. The components can be present in the composition in a weight ratio aluminum compound, alkaline earth metal salt and acid of from about 60:1:0.01 to about 5:1:0.1. The composition according to the invention can be easily prepared by mixing the aluminum compound, alkaline earth metal salt and acid, preferably under stirring.

The components according to the invention can be added to the thick suspension in amounts which can vary within wide limits. Generally, the components are added in amounts that give better drainage, retention and/or yield in the papermaking process than what is obtained when not adding the components. The aluminum compound is usually added in an amount of at least about 10 kg/ton, ton referring to a metric ton and based on the dry weight of the thick suspension, often at least about 30 kg/ton, and the upper limit is usually about 90 kg/ton and suitably about 40 kg/ton. Likewise, if used, the alkaline earth metal salt is usually added in an amount of at least about 0.5 kg/ton, often at least about 1.0 kg/ton, and the upper limit is usually about 40 kg/ton and suitably about 35 kg/ton. Similarly, the acid is usually added in an amount of at least about 0.01 kg/ton, often at least about 0.05 kg/ton and the upper limit is usually about 2.0 kg/ton and suitably about 1.5 kg/ton. When using the aqueous composition according to the invention, it is usually added in an amount of at least about 10 kg/ton, often at least about 30 kg/ton, and the upper limit is usually about 120 kg/ton and suitably about 50 kg/ton.

Subsequent to adding to the thick suspension the aluminum compound, alkaline earth metal salt and acid according to the invention, the thick suspension is diluted to form an aqueous thin suspension containing cellulosic fibers having a fiber concentration of less than 2% by weight, herein also referred to a thin suspension. The thin suspension usually has a fiber concentration of from about 0.2 to about 1.5% by weight, for example from about 0.5 to about 1.0% by weight. The dilution can be effected by means of any aqueous phase such as, for example, water, aqueous solution and aqueous suspension, e.g. white water or clarified white water.

After adding the aluminum compound, alkaline earth metal salt and acid according to the invention, if desired, the pH of the aqueous thick or thin suspension can be increased to be in the range of from about 5.5 to about 10, suitably from about 6 to about 9, and preferably from about 6 to about 8, by adding a base. Examples of suitable bases include bicarbonates and carbonates of alkali metals and alkali metal hydroxides, suitably sodium bicarbonate, sodium carbonate and sodium hydroxide, preferably sodium hydroxide. The base can be added prior to, simultaneously with or after the addition of drainage and retention aids. The base is preferably added prior to the addition of drainage and retention aids.

One or more drainage and retention aids are used according to the invention, preferably in a papermaking process. The process comprises diluting the thick suspension, which may be obtained from the pulping process, to form a thin suspension, adding to the thin suspension one or more drainage and retention aids and dewatering the obtained suspension. The term "drainage and retention aids", as used herein, refers to one or more additives which, when added to a suspension containing cellulosic fibers, give better drainage and retention than what is obtained when not adding the said one or more additives.

Examples of suitable drainage and retention aids include cationic and anionic, organic polymers, siliceous materials, and mixtures thereof. The use of organic polymers and siliceous materials as drainage and retention aids, or as flocculating agents, is well known in the art. Preferably, at least one cationic polymer is used as a drainage and retention agent. The term "cationic polymer", as used herein, refers to an organic polymer having one or more cationic groups. The cationic polymer may also contain anionic groups, as long as the polymer has an overall cationic charge. The term "anionic polymer", as used herein, refers to an organic polymer having one or more anionic groups. The anionic polymer may also contain cationic groups, as long as the polymer has an overall anionic charge.

Polymers suitable for use in the process can be derived from natural or synthetic sources, and they can be linear, branched or cross-linked. Examples of suitable polymers include cationic polysaccharides, preferably starches; cationic and anionic chain-growth polymers, preferably cationic and anionic acrylamide-based polymers; as well as cationic poly(diallyl-dimethyl ammonium chloride); cationic polyethylene imines; cationic polyamines; cationic polyamideamines and vinylamide-based polymers. Cationic starch and cationic acrylamide-based polymers are particularly preferred polymers and they can be used singly, together with each other or together with other polymers, e.g. other cationic and/or anionic polymers. The weight average molecular weight of the polymer is suitably above 1,000,000 and preferably above 2,000,000. The upper limit is not critical; it can be about 50,000,000, usually 30,000,000 and suitably about 25,000,000. However, the molecular weight of polymers derived from natural sources may be higher.

Examples of suitable siliceous materials include anionic silica-based particles and anionic clays of the smectite type. Preferably, the siliceous material has particles in the colloidal range of particle size. Anionic silica-based particles, i.e. particles based on $SiO_2$ or silicic acid, are preferably used and such particles are usually supplied in the form of aqueous colloidal dispersions, so-called sols. Examples of suitable silica-based particles include colloidal silica and different types of polysilicic acid, either homopolymerised or co-polymerised, for example polymeric silicic acid, polysilicic acid microgel, polysilicate and polysilicate microgel. The silica-based sols can be modified and contain other elements, e.g. aluminum, boron, nitrogen, zirconium, gallium, titanium and the like, which can be present in the aqueous phase and/or in the silica-based particles. Examples of suitable silica-based particles of this type include colloidal aluminum-modified silica, aluminum silicates, polyaluminosilicate and polyaluminosilicate microgel. Mixtures of such suitable silica-based particles can also be used. Examples of suitable drainage and retention aids comprising anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Examples of suitable anionic silica-based particles include those having an average particle size below about 100 nm, preferably below about 20 nm and more preferably in the range of from about 1 to about 10 nm. As conventional in the silica chemistry, the particle size refers to the average size of the primary particles, which may be aggregated or non-aggregated. The specific surface area of the silica-based particles is suitably above 50 $m^2/g$ and preferably above 100 $m^2/g$. Generally, the specific surface area can be up to about 1700 $m^2/g$ and preferably up to 1000 $m^2/g$. The specific surface area is measured by means of titration with NaOH in a well known manner, e.g. as described by G. W. Sears in Analytical Chemistry 28(1956): 12, 1981-1983 and U.S. Pat. No. 5,176,891. The given area thus represents the average specific surface area of the particles.

In a preferred embodiment of the invention, use is made of the silica-based particles which are present in a sol having a S-value in the range of from 8 to 50%, preferably from 10 to 40%. The S-value can be measured and calculated as described by Iler & Dalton in J. Phys. Chem. 60(1956), 955-957. The S-value indicates the degree of aggregation or microgel formation and a lower S-value is indicative of a higher degree of aggregation.

Examples of suitable anionic clays of the smectite type include those carrying a negative charge at the surface, including montmorillonite/bentonite, hectorite, beidelite, nontronite, saponite, laponite, preferably bentonite. Examples of suitable anionic bentonite clays include those disclosed in U.S. Pat. Nos. 4,753,710; 5,071,512; and 5,607,552, which are hereby incorporated herein by reference.

Cationic coagulants, also referred to as anionic trash catchers and fixatives, can of course also be used in the process according to the invention. Examples of suitable cationic coagulants include water-soluble organic polymeric coagulants. The cationic coagulants can be used singly or together, i.e. a polymeric coagulant can be used in combination with an inorganic coagulant. Examples of suitable water-soluble organic polymeric cationic coagulants include cationic polyamines, polyamideamines, polyethylene imines, dicyandiamide condensation polymers and polymers of water soluble ethylenically unsaturated monomer or monomer blend which is formed of 50 to 100 mole % cationic monomer and 0 to 50 mole % other monomer. The amount of cationic monomer is usually at least 80 mole %, suitably 100%. Examples of suitable ethylenically unsaturated cationic monomers include dialkylaminoalkyl (meth)-acrylates and -acrylamides, preferably in quaternised form, and diallyl dialkyl ammonium chlorides, e.g. diallyl dimethyl ammonium chloride (DADMAC), preferably homopolymers and copolymers of DADMAC. The organic polymeric cationic coagulants usually have a weight average molecular weight in the range of from 1,000 to 3,000,000, suitably from 5,000 to 700,000, and preferably from 10,000 to 500,000.

The drainage and retention aid(s) can be added to the thin suspension in conventional manner and in any order. When using a siliceous material, it is preferred to add a cationic polymer to the thin suspension before adding the siliceous material, even if the opposite order of addition may also be used. It is further preferred to add a cationic polymer before a shear stage, which can be selected from pumping, mixing, cleaning, etc., and to add the siliceous material after that shear stage. When using a cationic coagulant, it is preferably introduced into the suspension prior to introducing cationic polymer and siliceous material, if used. Alternatively, the cationic coagulant and cationic polymer can be introduced into the suspension essentially simultaneously, either separately or in admixture, e.g. as disclosed in U.S. Pat. No. 5,858,174, which is hereby incorporated herein by reference.

The drainage and retention aid(s) can be added to the thin suspension to be dewatered in amounts which can vary within wide limits depending on, inter alia, type and number of additives, type of cellulosic suspension, salt content, type of salts, filler content, type of filler, point of addition, degree of white water closure, etc. Generally, the retention and drainage aid(s) are added in amounts that give better drainage and/or retention than what is obtained when not using the additives. The cationic polymer is usually added in an amount of at least about 0.001% by weight, often at least about 0.005% by weight, based on dry cellulosic suspension, and the upper limit is usually about 3% and suitably about 1.5% by weight. Commonly applied addition amounts of cationic polymer are from about 0.01% up to about 0.5% by weight. Anionic materials, e.g. siliceous materials, i.e. anionic silica-based particles and anionic clays of the smectite type, and anionic organic polymers, are usually added in an amount of at least about 0.001% by weight, often at least about 0.005% by weight, based on dry cellulosic suspension, and the upper limit is usually about 1.0% and suitably about 0.6% by weight.

When using a cationic coagulant in the process, it can be added in an amount of at least about 0.001% by weight, calculated as dry coagulant on dry cellulosic suspension. Suitably, the amount is in the range of from about 0.05 up to about 3.0%, preferably in the range from about 0.1 up to about 2.0%.

In the process, other components may of course be introduced into the cellulosic suspension. Examples of such components include conventional fillers, optical brightening agents, sizing agents, dry strength agents, wet strength agents, etc. Examples of suitable conventional fillers include kaolin, china clay, titanium dioxide, gypsum, talc, natural and synthetic calcium carbonates, e.g. chalk, ground marble and precipitated calcium carbonate, hydrogenated aluminum oxides (aluminum trihydroxides), calcium sulfate, barium sulfate, calcium oxalate, etc. Examples of suitable sizing agents include non-cellulose-reactive sizing agents, e.g. rosin-based sizing agents like rosin-based soaps, rosin-based emulsions/dispersions, and cellulose-reactive sizing agents, e.g. emulsions/dispersions of acid anhydrides like alkenyl succinic anhydrides (ASA), alkenyl and alkyl ketene dimers (AKD) and multimers. Examples of suitable wet strength agents include polyamines and polyaminoamides.

The present invention further encompasses papermaking processes where white water is extensively recycled, or recirculated, i.e. with a high degree of white water closure, for example where from 0 to 30 tons of fresh water are used per ton of dry paper produced, usually less than 20, preferably less than 15, more preferably less than 10 and notably less than 5 tons of fresh water per ton of paper. Fresh water can be introduced in the process at any stage; for example, fresh water can be mixed with cellulosic fibers in order to form a cellulosic suspension, and fresh water can be mixed with a thick cellulosic suspension to dilute it so as to form a thin cellulosic suspension.

The process according to the invention is used for the production of a cellulosic product and preferably paper. The term "paper", as used herein, includes not only paper and the production thereof, but also other web-like products, such as for example board and paperboard, and the production thereof. The process can be used in the production of paper from different types of suspensions of cellulosic fibers, as defined above, and the suspensions should preferably contain at least 25% and more preferably at least 50% by weight of such fibers, based on dry substance.

Preferably, the invention is applied on paper machines producing wood-containing paper and paper based on recycled fibers, such as SC, LWC and different types of book and newsprint papers, and on machines producing wood-free printing and writing papers, the term wood-free meaning less than about 15% of wood-containing fibers. Examples of preferred applications of the invention include the production of paper and layer of multilayered paper from cellulosic suspensions containing at least 50% by weight of mechanical and/or recycled fibers. Preferably the invention is applied on paper machines running at a speed of from 300 to 3000 m/min and more preferably from 500 to 2500 m/min.

The invention is further illustrated in the following Examples which, however, are not intended to limit the same. Parts and % relates to parts by weight and % by weight, respectively, unless otherwise stated.

Example 1

Drainage performance achieved by the present process was evaluated by means of a Dynamic Drainage Analyser (DDA), available from Akribi Kemikonsulter A B, Sweden, which measures the time for draining a set volume of an aqueous suspension containing cellulosic fibers through a wire when removing a plug and applying vacuum (0.35 bar) to that side of the wire that is opposite to the side on which the cellulosic suspension is present. First pass retention was evaluated by means of a nephelometer by measuring the turbidity of the filtrate, the white water, obtained by draining the suspension. The turbidity was measured in NTU (Nephelometric Turbidity Units). The higher the NTU, the less of the material is retained.

The cellulosic suspension used was derived from a mixture of thermo mechanical pulp (TMP) (70%) and stone groundwood pulp (SGW) (30%) which was hydrogen peroxide/sodium silicate bleached. The suspension was diluted with water to 4% fiber concentration and treated with a mixture comprising alum and magnesium sulfate salt in a weight ratio 35:1.87. After the treatment, the pH was reduced to about 5 by addition of sulfuric acid ($H_2SO_4$) and kept at 40° C. for 30 min. Then the suspension was diluted with water to a fiber concentration of 1% by weight and pH was maintained at 5 by additional sulfuric acid before making the DDA test.

The samples were put into the baffled DDA jar. The retention and dewatering aids were added as follows:

i) 15 seconds before draining the suspension, varying amounts of cationic polyacrylamide (Eka PL 1510).

ii) 5 seconds before draining the suspension, 0.5 kg/ton of anionic silica-based particles (Eka NP 320).

The amounts are based on the dry weight of the cellulosic suspension and ton refers to a metric ton in all examples. Test Nos. 1-3, 5-7, 9, 10 and 12 to 18 were used for comparison and Test Nos. 4, 8 and 11 show results obtained by the treatment according to the invention.

TABLE 1

| Test No. | Addition of Alum [kg/ton] | Addition of Mixture (Alum:$MgSO_4$) [kg/ton] | Addition of Cationic Polymer [kg/ton] | Drainage Time [s] | Turbidity [NTU] |
|---|---|---|---|---|---|
| 1 | 0 | 0 | 0.5 | 19.3 | 214 |
| 2 | 15 | 0 | 0.5 | 17.9 | 214 |
| 3 | 35 | 0 | 0.5 | 15.0 | 196 |
| 4 | 0 | 35:1.87 | 0.5 | 12.0 | 176 |
| 5 | 0 | 0 | 1.0 | 15.3 | 205 |
| 6 | 15 | 0 | 1.0 | 15.3 | 197 |
| 7 | 35 | 0 | 1.0 | 11.9 | 172 |
| 8 | 0 | 35:1.87 | 1.0 | 9.3 | 124 |
| 9 | 15 | 0 | 1.25 | 14.7 | 190 |
| 10 | 35 | 0 | 1.25 | 10.5 | 148 |
| 11 | 0 | 35:1.87 | 1.25 | 7.1 | 101 |
| 12 | 0 | 0 | 1.5 | 14.4 | 165 |
| 13 | 15 | 0 | 1.5 | 14.0 | 190 |
| 14 | 35 | 0 | 1.5 | 9.2 | 126 |
| 15 | 0 | 0 | 2.0 | 12.2 | 146 |
| 16 | 15 | 0 | 2.0 | 10.5 | 164 |
| 17 | 0 | 0 | 3.0 | 9.6 | 121 |
| 18 | 15 | 0 | 3.0 | 8.2 | 137 |

As can be seen from the results presented in Table 1, the suspension treated with alum and magnesium sulfate according to the present invention resulted in a better drainage and retention performance than the suspension treated with only alum and the suspension that was not treated at all.

Example 2

In this example, drainage and retention performance was evaluated according to the general procedure of Example 1, except that a cationic coagulant was also used. The cationic coagulant and retention and dewatering aids were added as follows:

i) 30 seconds before draining the suspension, varying amounts of cationic polyacrylamide coagulant (Eka ATC 5439);

ii) 15 seconds before draining the suspension, 0.5 kg/ton of cationic polyacrylamide drainage and retention aid (Eka PL 1510)

iii) 5 seconds before draining the suspension, 0.5 kg/ton of dry pulp of anionic silica-based particles (Eka NP 320).

Test Nos. 19-21, 24-26, 28-30 and 32-34 were used for comparison and Test Nos. 22, 23, 27 and 31 show the treatment according to the invention.

TABLE 2

| Test No. | Addition of Alum [kg/t] | Addition of Mixture (Alum:$MgSO_4$) [kg/ton] | Addition of Cationic Coagulant [kg/ton] | Drainage Time [s] | Turbidity [NTU] |
|---|---|---|---|---|---|
| 19 | 0 | 0 | 0 | 19.3 | 214 |
| 20 | 15 | 0 | 0 | 15 | 214 |
| 21 | 35 | 0 | 0 | 17.9 | 196 |
| 22 | 0 | 35:1.87 | 0 | 12 | 176 |
| 23 | 0 | 35:1.87 | 0.25 | 11 | 130 |
| 24 | 0 | 0 | 0.5 | 16.1 | 200 |
| 25 | 15 | 0 | 0.5 | 11.3 | 202 |
| 26 | 35 | 0 | 0.5 | 15.3 | 160 |
| 27 | 0 | 35:1.87 | 0.5 | 8.8 | 99 |
| 28 | 0 | 0 | 0.75 | 15.7 | 178 |
| 29 | 15 | 0 | 0.75 | 9.9 | 200 |
| 30 | 35 | 0 | 0.75 | 14.9 | 129 |
| 31 | 0 | 35:1.87 | 0.75 | 7.3 | 85 |
| 32 | 0 | 0 | 1.0 | 14.2 | 171 |
| 33 | 15 | 0 | 1.0 | 8.5 | 178 |
| 34 | 35 | 0 | 1.0 | 13.8 | 103 |

As can be seen from the results presented in Table 2, the suspension treated with alum and magnesium sulfate according to the present invention resulted in a better drainage and retention performance than the suspension treated with only alum and the suspension that was not treated at all.

Example 3

In this example, yield of the process was evaluated when using the composition according to the present invention comprising alum and magnesium sulfate.

A large batch of Hydrogen Peroxide/Sodium Silicate bleached TMP/SGW was diluted with water to a fiber concentration of 4%. This batch was well mixed and divided into four equal amounts. The obtained suspensions were treated in different ways. However, all suspensions were diluted in a constant manner and the change in paper basis weight was evaluated. The treatments of the suspensions are presented in Table 3.

TABLE 3

| Test No. | Treatment |
|---|---|
| 1 | No treatment. pH was reduced to 5 by addition sulfuric acid and kept at 40° C. for 30 min. Then the concentration of the suspension was decreased to 1% with a set volume. The set volume to reach 1% was used in all tests. |
| 2 | Treatment with alum at 4% pulp concentration. 35 kg/ton of alum was dosed and pH was adjusted to 5 by addition of sulfuric acid. This was then kept at 40° C. for 30 min and then diluted according to Test No. 1. |
| 3 | Treatment with a mixture comprising alum and magnesium sulfate at 4% pulp concentration. The mixture was mixed in such a ratio that effective dose was 35 kg/ton of alum and 1.87 kg/ton of magnesium sulphate, and pH was adjusted to 5 by addition of sulfuric acid. This was then kept at 40° C. for 30 min and then diluted according to Test No. 1. |
| 4 | Treatment with the mixture comprising alum and magnesium sulfate at 1% pulp concentration. The mixture was mixed in such a ratio that effective dose is 35 kg/ton of alum and 1.87 kg/ton of magnesium sulphate, and pH was adjusted to 5 by addition of sulphuric acid. This was then kept at 40° C. for 30 min. |

All four samples had the same set dilution and were not compensated for solids change. Handsheets were prepared according to the method described in SCAN-CN 64:00 and 5 kg/ton of cationic starch was used as a drainage and retention aid. 25 sheets were made with recirculation of white water. 10 last sheets were used for the evaluation of the yield obtained. The inorganic yield increase was evaluated as an increase in the ash content which was evaluated by the method according to ISO 2144-1977. The results are presented in Table 4.

TABLE 4

| | Basis Weight | Yield Increase [%] | | |
|---|---|---|---|---|
| Test No. | [g/m$^2$] | Inorganic | Organic | Total |
| 1 | 69.37 | — | — | — |
| 2 | 70.47 | 0.30 | 1.29 | 1.59 |
| 3 | 72.07 | 0.50 | 3.40 | 3.90 |
| 4 | 71.01 | 0.62 | 1.75 | 2.36 |

As can be seen from the results presented in Table 4, the papermaking process in which alum and magnesium sulfate were used according to the present invention (Test No. 3) resulted to an increased yield of the process.

Example 4

In this example, paper quality was evaluated in terms of basis weight, ash content, thickness, density, bulk, tensile index, tear index, air permeability, brightness, opacity, light scattering and light absorption. Comparisons between paper sheets prepared from aqueous pulp suspensions derived from both unbleached and bleached pulp were made. The pulp suspensions were treated in different ways. The suspensions were derived from TMP/SGW (70/30) and alternatively hydrogen peroxide/sodium silicate bleached TMP/SGW (70/30). The suspensions in the tests were not treated at all, treated with calcinated clay or with alum, magnesium sulfate and acid. Further comparisons were made in a similar manner when cationic starch was added as a drainage and retention aid to the suspensions. Sheets were prepared using the standard method SCAN-CM 64:00. The treatments of the suspensions are presented in Table 5.

TABLE 5

| Test No. | Treatment |
|---|---|
| 1 | Unbleached TMP/SGW |
| 2 | Hydrogen peroxide/sodium silicate bleached TMP/SGW |
| 3 | Hydrogen peroxide/sodium silicate bleached TMP/SGW, addition of calcinated clay in an amount of 2.5% by weight, based on the dry weight of the suspension, to a diluted cellulosic suspension having a fiber concentration of 1% by weight. |
| 4 | Hydrogen peroxide/sodium silicate bleached TMP/SGW, addition of calcinated clay in an amount of 5.0% by weight, based on the dry weight of the suspension, to a diluted cellulosic suspension having a fiber concentration of 1% by weight. |
| 5 | Hydrogen peroxide/sodium silicate bleached TMP/SGW, treatment with a mixture comprising alum and magnesium sulfate at 4% pulp concentration. The mixture was used in such a ratio that effective dose was 35 kg/ton of alum and 1.87 kg/ton of magnesium sulphate, and pH was adjusted to 5 by addition of sulfuric acid. This was then kept at 40° C. for 30 min and then diluted to a fiber concentration of 1% by weight. |
| 6 | Hydrogen peroxide/sodium silicate bleached TMP/SGW, 5 kg/t cationic starch added 20 seconds before drainage. |
| 7 | Hydrogen peroxide/sodium silicate bleached TMP/SGW, addition of calcinated clay in an amount of 2.5% by weight, based on the dry weight of the suspension, to a diluted cellulosic suspension having fiber concentration of 1% by weight, 5 kg/ton cationic starch added 20 seconds before drainage. |
| 8 | Hydrogen peroxide/sodium silicate bleached TMP/SGW, addition of calcinated clay in an amount of 5.0% by weight, based on the dry weight of the suspension, to a diluted cellulosic suspension having a fiber concentration of about 1% by weight, 5 kg/ton of cationic starch added 20 seconds before drainage. |
| 9 | Hydrogen peroxide/sodium silicate bleached TMP/SGW, treatment with a mixture comprising alum and magnesium sulfate at 4% pulp concentration. The mixture was mixed in such a ratio that effective dose was 35 kg/ton of alum and 1.87 kg/ton of magnesium sulphate, and pH was adjusted to 5 by addition of sulfuric acid. This was then kept at 40° C. for 30 min, diluted to a fiber concentration of 1% by weight and then 5 kg/ton of cationic starch added 20 seconds before drainage. |

Basis weight was evaluated according to standard ISO 536:1995, ash content according to ISO 2144-1977, thickness, bulk and density according to ISO 534:1988, tensile index according to SCAN-P 67:93 kN/kg, tear index according to ISO 1974:1990 and air permeability according to ISO 5636-5:2003.

TABLE 6

| Test No. | Basis Weight [g/m$^2$] | Ash Content [%] | Thickness [μm] | Density [kg/dm$^3$] | Bulk [dm$^3$/kg] | Tensile Index [kN/kg] | Tear Index [mNm$^2$/g] | Air Permeability [s] |
|---|---|---|---|---|---|---|---|---|
| 1 | 59.38 | 0.43 | 169 | 351 | 2.85 | 18.4 | 2.97 | 9.0 |
| 2 | 62.35 | 1.01 | 175 | 356 | 2.81 | 21.0 | 3.74 | 31.4 |
| 3 | 59.14 | 1.51 | 174 | 349 | 2.87 | 21.0 | 3.48 | 22.0 |
| 4 | 60.67 | 2.12 | 172 | 344 | 2.91 | 19.2 | 3.69 | 22.3 |
| 5 | 58.64 | 2.85 | 175 | 335 | 2.98 | 17.2 | 3.35 | 13.6 |
| 6 | 64.83 | 1.24 | 178 | 364 | 2.75 | 20.9 | 3.48 | 23.0 |
| 7 | 63.93 | 3.01 | 174 | 371 | 2.70 | 20.1 | 3.35 | 26.9 |
| 8 | 64.49 | 4.78 | 173 | 370 | 2.71 | 20.4 | 3.53 | 22.5 |
| 9 | 62.84 | 3.41 | 177 | 355 | 2.82 | 20.9 | 3.43 | 12.1 |

Paper quality was also evaluated in terms of brightness, opacity, light scattering and light absorption. The measurements were made by means of equipment, Technidyne, Colour Touch, and according to standards ISO 2470 for brightness, ISO 2471 for opacity and ISO 9416 for light spreading and light absorption.

TABLE 7

| Test No. | Brightness [%] | Opacity [%] | Light Scattering [m$^2$/kg] | Light Absorption [m$^2$/kg] |
|---|---|---|---|---|
| 1 | 58.97 | 93.40 | 55.15 | 2.64 |
| 2 | 75.31 | 86.23 | 54.21 | 0.49 |
| 3 | 75.37 | 86.94 | 57.16 | 0.58 |
| 4 | 75.71 | 86.80 | 58.48 | 0.61 |
| 5 | 76.12 | 86.04 | 56.96 | 0.52 |
| 6 | 75.00 | 88.24 | 57.22 | 0.62 |
| 7 | 75.90 | 89.24 | 61.86 | 0.62 |
| 8 | 77.26 | 90.09 | 67.86 | 0.63 |
| 9 | 75.84 | 88.07 | 58.70 | 0.64 |

As can be seen from the results presented in Tables 6 and 7, Test No. 9, where the sheets were prepared with a process according to the present invention, showed about the same or even better paper characteristics than the sheets prepared with a papermaking process using calcinated clay as an additive.

The invention claimed is:

1. A process for the production of a cellulosic product which comprises:

(i) providing an aqueous thick suspension containing cellulosic fibers having a fiber concentration of at least about 2% by weight;

(ii) adding to the thick suspension;

(I) an aluminum compound;

(II) an alkaline earth metal salt;

(III) an acid;

(iii) diluting the obtained thick suspension to form a thin suspension;

(iv) adding to the thin suspension one or more drainage and retention aids; and (v) dewatering the obtained thin suspension.

2. The process according to claim 1, wherein the aluminum compound is alum, polyaluminumchloride, polyaluminumsilicate sulfate, aluminate, aluminum nitrate or a mixture thereof.

3. The process according to claim 1, wherein the alkaline earth metal salt is a magnesium, calcium or barium salt.

4. The process according to claim 1, wherein the acid is hydrochloric acid or sulphuric acid.

5. The process according to claim 1, wherein the acid is added to the thick suspension to obtain a pH of from about 4 to about 5.5.

6. The process according to claim 1, wherein after adding the aluminum compound, alkaline earth metal salt and acid, the pH of the thick suspension is increased to the range of from about 6 to about 8 by adding a base.

7. The process according to claim 1, wherein the thick suspension has a fiber concentration of at least about 3.5% by weight.

8. The process according to claim 1, wherein the aqueous suspension contains cellulosic fibers derived from mechanical pulp.

9. The process according to claim 8, wherein the pulp is hydrogen peroxide bleached.

10. The process according to claim 1, wherein:

(I) the aluminum compound;

(II) the alkaline earth metal salt, and (III) the acid;

are separately added to the suspension.

11. The process according to claim 1, wherein:

(I) the aluminum compound;

(II) the alkaline earth metal salt; and/or (III) the acid;

are added to the suspension in the form of a mixture.

12. The process according to claim 1, wherein the drainage and retention aids comprise one or more cationic organic polymers.

13. The process according to claim 1, wherein the drainage and retention aids comprise a siliceous material.

14. The process according to claim 1, wherein the drainage and retention aids comprise a cationic organic polymer, which is added before a shear stage, and a siliceous material, which is added after that shear stage.

15. The process according to claim 1, wherein the drainage and retention aids comprise anionic silica-based particles.

16. The process according to claim 1, wherein the cellulosic product is paper.

17. The process according to claim 1, wherein the process for the production of a cellulosic product takes place in an integrated paper mill.

18. A process for the production of a cellulosic product which comprises:

(i) providing an aqueous thick suspension containing cellulosic fibers having:

(a) a fiber concentration of at least about 2% by weight; and (b) an alkaline earth metal ion concentration of at least about 100 mg/l;

and wherein said aqueous suspension contains cellulosic fibers derived from mechanical pulp which has been hydrogen peroxide bleached;

(ii) adding to the thick suspension an aluminum compound and optionally an acid to obtain a pH of from about 4 to about 5.5, wherein said aluminium compound is selected from the group consisting of alum, polyaluminumchloride, polyaluminumsilicate sulfate, aluminate, aluminum nitrate and mixtures thereof;

(iii) diluting the obtained thick suspension to form a thin suspension;

(iv) adding to the thin suspension one or more drainage and retention aids selected from the group consisting of cationic organic polymers, anionic organic polymers, siliceous materials and mixtures thereof; and (v) dewatering the obtained thin suspension.

19. The process according to claim 18, wherein after adding the aluminum compound, alkaline earth metal salt and the optional acid, the pH of the thick suspension is increased to the range of from about 6 to about 8 by adding a base.

20. The process according to claim 18, wherein the thick suspension has a fiber concentration of at least about 3.5% by weight.

* * * * *